US006598597B1

(12) United States Patent
Marocco et al.

(10) Patent No.: US 6,598,597 B1
(45) Date of Patent: Jul. 29, 2003

(54) METHOD FOR CUTTING BLOCKS OF STONE AND FRAME CUTTING MACHINE FOR CARRYING OUT SAID METHOD

(75) Inventors: Giuseppe Marocco, Turin (IT); Mauro Lunardi, Turin (IT)

(73) Assignee: Geo S.r.l., Turin (IT)

( * ) Notice: Subject to any disclaimer, the term of this patent is extended or adjusted under 35 U.S.C. 154(b) by 0 days.

(21) Appl. No.: 09/701,727

(22) PCT Filed: Mar. 30, 1999

(86) PCT No.: PCT/IT99/00077

§ 371 (c)(1),
(2), (4) Date: Nov. 30, 2000

(87) PCT Pub. No.: WO00/58063

PCT Pub. Date: Oct. 5, 2000

(51) Int. Cl.[7] ..... B28D 1/06
(52) U.S. Cl. ..... 125/16.01; 125/16.02; 125/19; 51/263
(58) Field of Search ..... 125/16.01, 16.02, 125/19, 15, 21, 14; 30/393; 51/59, 263

(56) References Cited

U.S. PATENT DOCUMENTS 568,731 A * 10/1896 Bielhen ..... 125/16.01
1,921,697 A * 8/1933 Owens et al. ..... 125/16.01
2,554,678 A 5/1951 Minkler et al.
2,963,018 A 12/1960 Mattson et al.
4,226,223 A * 10/1980 Pacini ..... 125/16.01
4,287,869 A * 9/1981 Schmid ..... 125/12
5,233,968 A * 8/1993 Vannucci ..... 125/14

FOREIGN PATENT DOCUMENTS

| | | |
|---|---|---|
| EP | 0 002 265 | 12/1978 |
| FR | 2457755 | 12/1980 |
| WO | PCT/EP90/01994 | 5/1991 |
| WO | PCT/EP92/01335 | 12/1992 |

* cited by examiner

*Primary Examiner*—Joseph J. Hail, III
*Assistant Examiner*—Anthony Ojini
(74) *Attorney, Agent, or Firm*—Paul & Paul

(57) ABSTRACT

The invention refers to a method for cutting blocks of stone (12), by means of a gangsaw (1) provided with diamond sector blades (35), comprising, besides a reciprocal approaching movement between the blades (35) and the block (12) and a periodical reciprocating movement of the blades (35), also a cyclic movement of approaching and moving away of the blades (35) relative to the block (12) and a hunting movement of the blade-holder frame. (FIG. 1)

15 Claims, 7 Drawing Sheets

METHOD FOR CUTTING BLOCKS OF STONE AND FRAME CUTTING MACHINE FOR CARRYING OUT SAID METHOD

BACKGROUND OF THE INVENTION

The present invention refers to a method for cutting blocks of granite, marble and other stone materials, conglomerate, concrete and similar.

The invention refers likewise to an oscillating frame machine, comprising a plurality of parallel blades provided with diamond segments, suitable for cutting stone blocks or similar materials into flat slabs, even of large dimensions.

Normally Indeed the stone blocks are cut in large slabs, using multi-blade gangsaws, or directly in unitary small sizes, using diamond disk sawing machines.

While an horizontal multi-blade gangsaw is able to cut slabs high up to 2 meters, a disk sawing machine can cut a total height not much greater then the third of the diameter of the same disk, which therefore should have an impossible diameter of five meters for cutting a similar height of slab.

Moreover in order to have supports and diamond segments of analogous thickness, and therefore analogous losses of scrap material, it is necessary to compare a gangsaw blade with a disk having a diameter of only 600 millimeters, which allows to cut a slab height of only 200 millimeters, a tenth of the height that can be cut by a blade.

A disk suitable for cutting one meter in height has a diameter of more than 2.5 meters and diamond segments having a thickness of 12 millimeters in opposition to 5.5 millimeters of a diamond blade. The scrap material is therefore double, the cost of the tool is higher and the energy used during cutting is greater. The diamond disk has however a higher cutting speed, at least 10 times greater than that of a gangsaw blade.

The manufacturing process and consequent needs normally lead operators to chose one or the other cutting system.

The present state of the art permits the use of diamond segments whether in disks for cutting marble or in those for cutting granite. On the contrary the diamond blades are used only for cutting marble. For cutting granite are used steel blades transporting against the stone to be cut scattered grit carried by the washing water and mixed with additives. The cuts made in the block are 8/10 mm large and therefore 30–60% larger then the cuts of a diamond blade.

Consequently the cut with gangsaws having alternate rectilinear motion, although using similar machines for "soft" calcareous materials, situated under level 4 of Mohs scale, and for "hard" siliceous materials, which can exceed level 8, shows operating management substantially different and also installed power and cutting scraps very different, connected to the possibility of using or not blades provided with diamond segments.

Moreover the fact of using ferrous grit for cutting by means of multi-blade gangsaws granite and hard stones lets into the process and washing water, and therefore into the working environment, large quantities of iron oxide that contaminates and stains the materials. As a consequence the cutting operations of marble and granite, that are the first, and sometimes the only, in the manufacturing process of a factory, must be maintained separated in order to separate the circulation of processing waters.

First attempts of cutting granite with diamond blade gangsaws have been made during first seventies, when were introduced diamond gangsaws for cutting marble. IN these last 25 years, while the use of diamond gangsaws for cutting marble and soft stones was consolidating, attempts for cutting granite and other hard stones with diamond blade gangsaws went on but without relevant successes.

Among the causes of these unprofitable attempts are the following:

- The hardness of granites and other hard stones, much more similar to that of natural or synthetic diamond than to that of calcareous materials and soft stones.
- The reciprocating of blades that prevents the formation of a stable support for the single diamond granule, as the one that grows in the diamond segment when it moves always in the same direction. Since the segments move in two directions the diamond tends to oscillate and separate more easily from the binder and it is ejected prematurely.
- The inadequate contact linear velocity of the diamond segments of the gangsaw blade, much lower then that of a diamond disk.
- The inefficient drainage of scrap material and the consequent stay and entrainment in the two directions of the material counterabrasive for diamond made by granules of abraded material, having a hardness not much lower then that of diamond.

The attempts made till now for cutting granite by means of gangsaws having diamond blades did not lead to construction of diamond gangsaws technically efficient and economically valid for cutting granite.

In the patent U.S. Pat. No. 2,554,678 it is disclosed a gangsaw which uses a set of blades in a frame that is eccentrically connected to a couple of wheels having discordant movement, that transfer to the blades a reciprocating movement leading to an elliptic movement on a variable slope.

In the published documents EP 0 002 265 and WO 92/22408 are disclosed vertical gangsaws in which the blade frame moves along an elliptic path therefore carrying the blades in contact with the material to be cut during only one direction of the reciprocating movement. In order to increase the speed of the tools the gangsaws have been lightened and they are necessarily of the vertical type, with shortened blades.

The practical results of these solutions are not known but it can be noted that, while the gangsaw disclosed in document EP 0 002 265 has an operation that subjects the tools to irregular and not foreseeable loads and wears, the constructive criteria of the second gangsaw, disclosed in document WO 92/22408, do not allow to attack the material with adequate power and abrasive capability.

The document WO 92/22408 starts from the assumption, correct but over-estimated, that it is necessary to use specific diamond tools for the five hardness classes and cutting difficulties in which granites are classified.

Referring to cutting of calcareous stone materials using diamond gangsaws the practice confirmed that a blade having diamond sectors purposely designed and manufactured for a specific material can have optimal drops in that material. For example on travertine, that has a perforated structure, weak and very dry, that reduces stresses and facilitates drainage of abraded material, as it can be absorbed by holes, have been obtained drops of 50 cm/h and more. It is therefore justifiable that firms working exclusively on travertine use specific blades.

However the qualities of marble on the market are hundreds and it is not possible for a firm to equip itself with special blades for every type of marble and neither with special blades for families of materials. In this field indeed are used universal blades and the gangsaw operation is so programmed that, after cutting a block of material that gums the blades, is cut a more abrasive and dry block that dresses them. The drops, the yield and average costs obtained are considered acceptable. If we also consider the greater hardness and different structure of granite, the logic should be the same and lead to the construction of universal diamond blades also for granite.

As regards granite, it is commonly believed that it cannot be cut in a cost-effective way using a diamond gangsaw because the speed of the tool is too low. The optimal speed, given by manufacturers of diamond tools for cutting granite, is in fact approximately 20 m/s, while the medium possible speed on a gangsaw is 1 m/s. Therefore it should not be possible to cut granite using a diamond gangsaw because the possible linear speed of the tool is not sufficient. But if this would be a valid reason it would remain to explain why diamond gangsaws operate correctly on marble, where the suggested correct speed is double, more then 40 m/s. And also why the diamond cost per square meter cut is substantially the same for a disk, having optimal tip speed, and for a blade that operates at not constant speed, with a wrong average speed, equal to approximately 3% of optimal speed.

The truth is that the high tip or linear speed of the diamond tool, which is however difficult to increase in gangsaws because of relevant masses reciprocally moved, is not determinant either for the possibility of cutting material or for defining the final cost of the operation, wherein the wear of the tool is determinant. On the contrary it is a most important factor to obtain an efficient drainage for the material abraded during cutting, in order to eliminate or minimise the counterabrasion effect on diamond sectors.

Diamond gangsaws currently used for cutting marbles and soft stones are machines having a very simple operation in which the only parameters controllable and changeable during operation are the drop, i.e. the approaching speed between blades and material or vice versa, and the quantity of lubricating water for the cut and the drainage of abraded material. In these gangsaws the blades and the diamond sectors are always in contact with the material to be cut.

SUMMARY OF THE INVENTION

A first object of the present invention it is therefore to provide a cutting method more efficient, cost-effective and speedy for marble and soft stones and to allow, using different tools, to cut blocks of granite or hard stone by means of a gangsaw, overcoming the defects of the prior art.

Another object of the present invention is to provide a diamond gangsaw having particular functions that allow to cut efficiently every stone material and analogous materials, even hard, using limited power and limited machining scraps.

The above objects of the present invention are reached from a method and a frame cutting machine as claimed in the accompanying claims.

According to the invention the method for cutting blocks of stone, by means of a frame provided with diamond sector blades, comprises, besides a reciprocal approaching movement between blades and block and a periodical reciprocating movement of the blades, also a cyclic movement of approaching and moving away of the blades relative to the block and a hunting movement of the blade frame.

Thanks to the presence of the cyclic movement of approaching and moving away of the blades relative to the block, the gangsaw according to the invention has better cutting characteristics in respect to prior art and at allows, thanks to the moving away of the blades from the block, to clear regularly the cutting groove from the abraded material.

BRIEF DESCRIPTION OF THE DRAWINGS

The above objects will result more clear from the detailed description of a preferred embodiment of the gangsaw according to the invention with particular reference to the accompanying drawings in which.

DETAILED DESCRIPTION OF THE INVENTION

Figure 1:
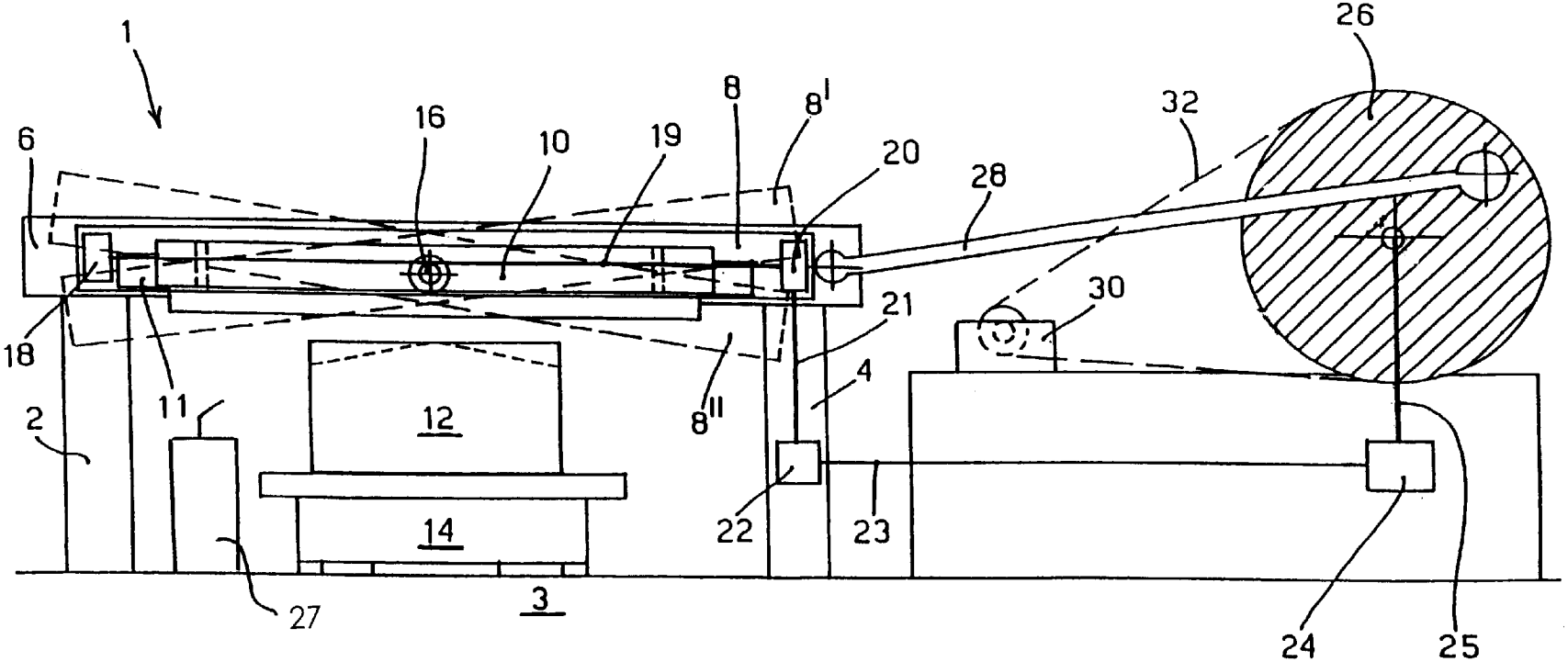
FIG. 1 is a lateral view of a gangsaw realised according to the present invention.

With reference to the enclosed figures now will be illustrated a method for cutting blocks of stone or similar material by means of a gangsaw provided with blades having diamond sectors, according to the present invention.

The cutting method provides substantially the following four main movements:

- a reciprocal approaching movement between the blade frame and the block of stone to be cut;
- a periodical longitudinal reciprocating movement of the blade frame relative to the block of stone;
- a cyclic movement of approaching and moving away of the blade frame relative to the block of stone, in a direction perpendicular to the direction of the periodical reciprocating movement;
- a hunting movement of the blade frame that allows to vary the inclination of the blades relative to the base of the stone block during the cutting operative cycle.

Utilising and controlling appropriately said movements, independently and according to predetermined programs for cutting different materials, it is possible to obtain the following innovative functions:

- it is possible to approach and remove the blades from the material in any position they are, in one or both running directions, allowing a full washing of the cutting grooves and drainage of abraded material;
- in addition to the drop advance, that is the reciprocal approaching movement between the blade frame and the stone block, it is possible to control, during the travel of the blades, the pressure of the diamond sectors coming in contact with the material to be cut at every cycle;
- controlling the speed of the cyclic movement of approaching and moving away of the blade frame relative to the block it is possible to perform a chipping action by means of the blades on the material, useful especially for cutting granite and hard stones;

it is possible to repeat several times the chipping operation during the course of an active cutting cycle;

it is possible to change the inclination of the blades and therefore of the diamond sectors in every operative cycle of the reciprocating periodic movement of the blade frame so that, in a running direction, the inclination of the blade frame is different and opposed to the inclination of the same frame in the opposite running direction;

it is possible to regulate, in particular to decrease, the frequency of the longitudinal reciprocating periodic movement of the blades relative to the block in order to precisely control the frequency and the working cycle of the cyclic approaching and moving away of the blade frame relative to the block.

By controlling the above mentioned functions it is possible to program an unlimited number of working cycles, suitable for the processing of various different materials.

First of all it is possible to avoid the contact between diamond sectors and material to be cut during the end center of the end of stroke, wherein the speed is zero, and to decide at what speed in every single cycle to re-establish the contact with the material and successively to remove it.

Moreover it is possible to fix that, during one of the alternative directions of the blade frame, the blades are not in contact with the material, or to fix the pressure/interference of the movement of the blades against the material, the approaching speed of the blades relative to the block, how many times during one cycle or again to reduce the translation speed of the blade frame.

Finally, getting the blades to work inclined in one direction in one way and in the opposite direction in the opposite way, it is possible to use a horizontal gangsaw in the two cutting ways engraving and cutting the material, in each way, only on half block producing two distinct and opposite sloping flows for the drainage of water and abraded material across the block starting from its centre.

Either in an horizontal gangsaw or in a vertical gangsaw this kind of operation allows to reduce by 50% the path and the contact surface of the blades on the material to be cut, but contemporaneously to utilise both directions of the uniform reciprocating harmonic motion.

The possibility of washing the cutting grooves without the presence of sectors and the blade themselves, ensuing from the possibility of regulating widely the contact paths between tools and material, improves the cutting process and extends the life of the blades. This is particularly valid during cutting of hard stone materials wherein the abraded material represents an efficient counter-abrasive for diamond.

By independently controlling the different functions of the gangsaw it is possible to utilise more efficient cycles when are required corrective operations for blade runs, when the cut starts and ends, or when is found a harder concretion in the stone.

Now will be described an embodiment of a gangsaw realised according to the present invention.

Figure 2:
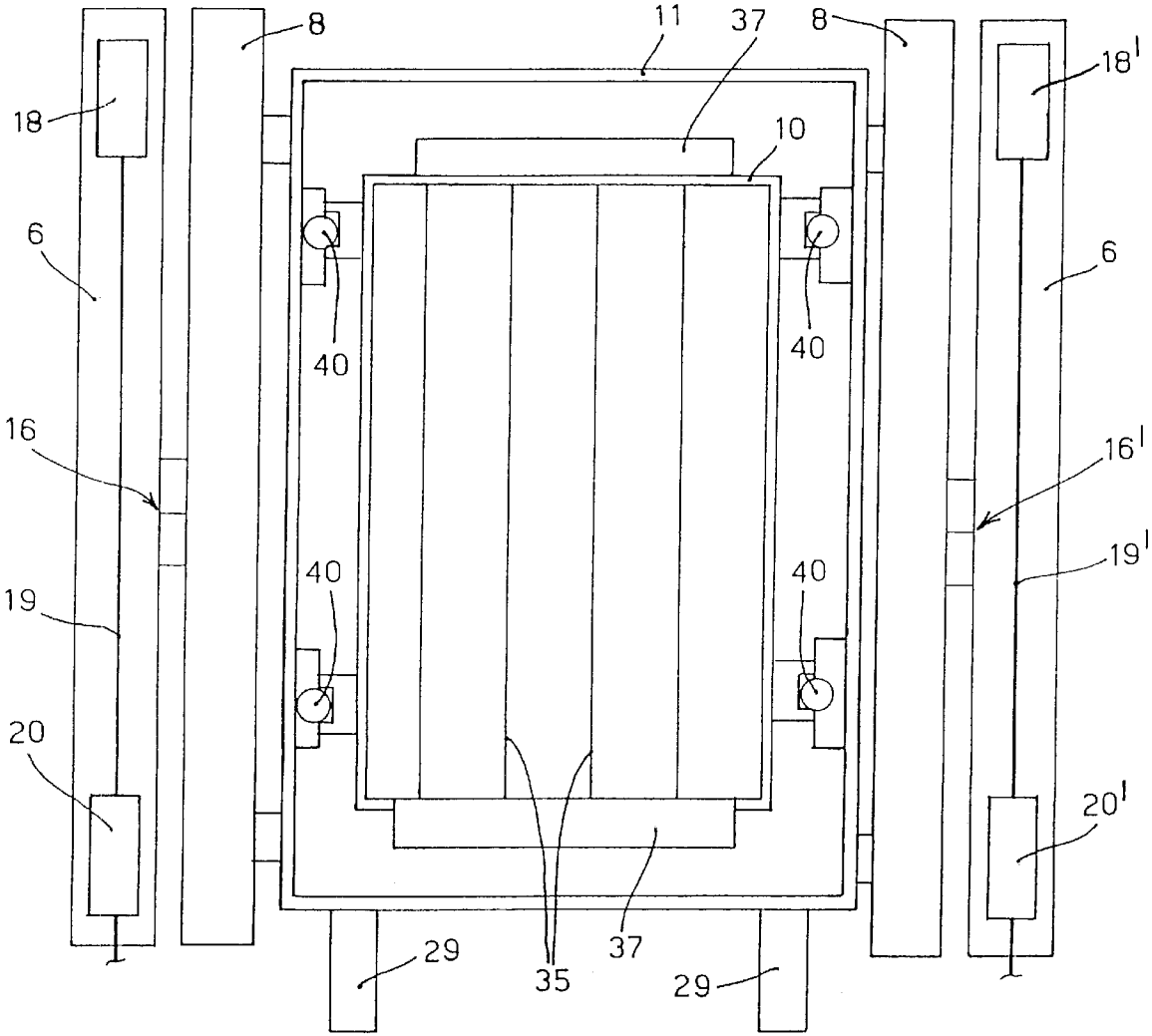
FIG. 2 is a top view of a blade frame of a gangsaw realised according to the present invention.
Figure 3:
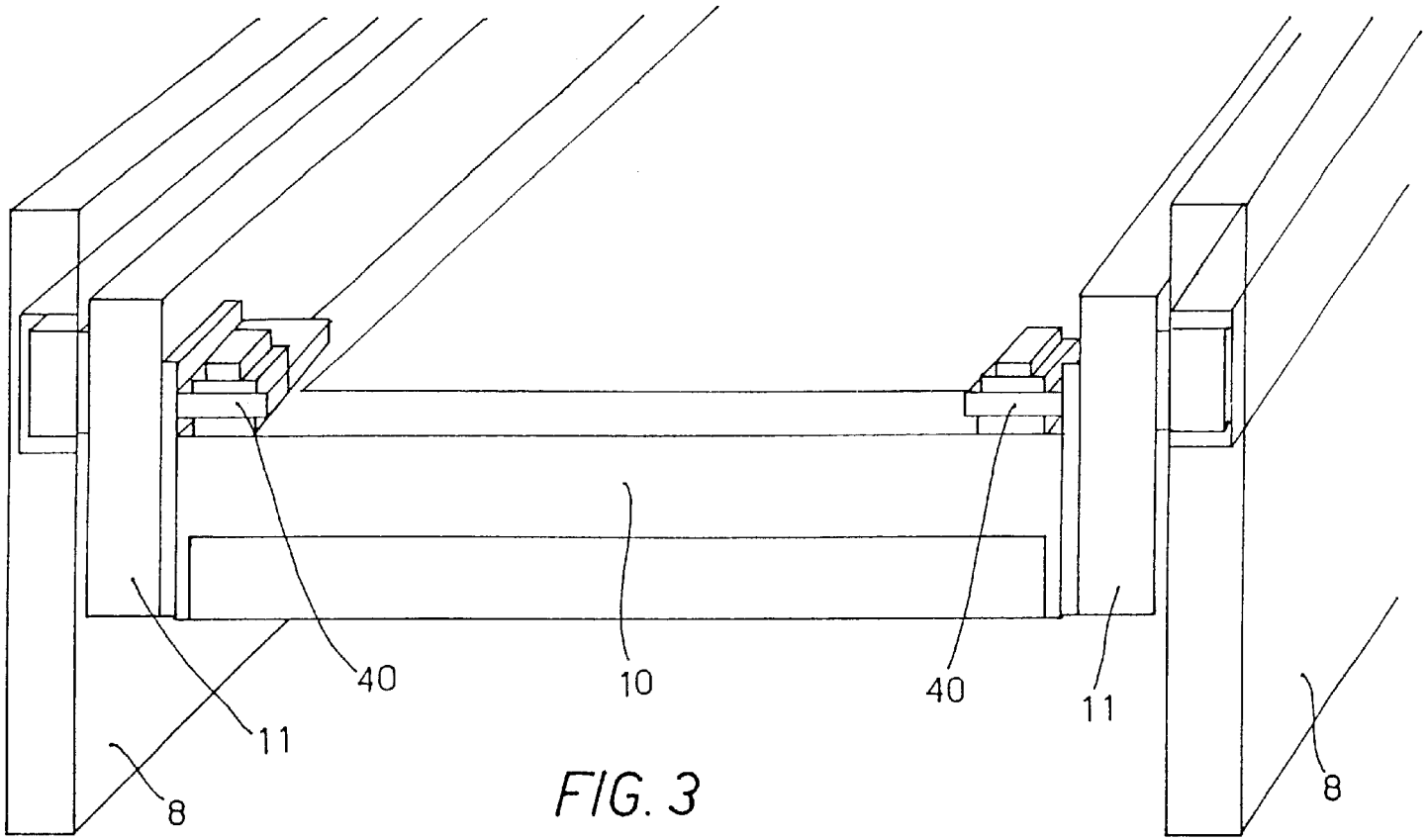
FIG. 3 is a part section front view of the blade frame shown in FIG. 2.

With reference to FIGS. 1, 2 and 3, a gangsaw 1 of the horizontal type comprises a supporting structure having four columns 2, 4 anchored to respective foundations in the floor 3 and connected on the top by side members 6 and transoms. The side members 6 support, by means of longitudinal guides 8, an horizontal blade-holder frame moved in a reciprocating motion by a connecting-rod/crank system. In particular it is connected by means of a connecting rod 28 to a crank which is coupled to a flywheel 26 that regularises its motion. The shaft of the flywheel is moved by means of a belt 32 which connects the pulley of a motor 30 to the flywheel 26, which operates as a big pulley.

A block of stone 12 rests on a basement 14 which can be raised vertically in order to bring the block near the blades as the cut proceeds. Alternatively the block could be resting on a fixed basement and the blade frame could be coupled to guides vertically movable by means of a screw/nut-screw system incorporated into the columns.

A cooling and lubricating system 27 is shown in FIG. 1 which provides the block with water for cooling and lubricating the blade.

The longitudinal guides 8, as better visible in FIG. 2, are coupled to the side members 6 by means of a central pivot 16, or fulcrum, and can be inclined in a first direction, pointed out in FIG. 1 by the short dashes line 8', or in an opposite direction 8". This hunting or oscillation movement can be controlled by means of actuators of the type pneumatic, hydraulic oleo-dynamic, electromagnetic or, as in the embodiment shown, by means of a mechanic transmission system. For clarity, in the drawing of FIG. 1, the inclination of the longitudinal guides 8 has been appositely increased.

The motion is taken directly from the shaft of the flywheel 26, by means of a first shaft 25 and transferred, by means of angular transmissions 24, 22, to four eccentric units 18, 18' and 20, 20' having opposite phases. When the two front units 18, 18' are in the lifted position the two rear units 20, 20' are lower and vice versa, tilting the blade frame first in a direction and then in the opposite.

Alternatively the longitudinal guides could be obtained in the same side members which could be made hunting by means of a hunting system, similar to that described above, placed into the four load bearing columns.

The blade frame, visible in detail in FIGS. 2 and 3, comprises an inner part 10, suitable for containing the blades 35 and the corresponding tensioning mechanisms 37, and an outer part 11, or counter-frame, coupled in a sliding way to the longitudinal guides 8. The external counter-frame 11 is connected to the connecting rod/crank system for the transmission of the reciprocating motion, by means of the coupling points 29, and transfers said motion to the inner frame 10. Inner frame 10 and outer counter-frame 11 are coupled together by means of four actuators 40 which allow cyclic reciprocal movements between the two parts in a vertical direction perpendicular to the cutting direction of the blades.

Alternatively the inner frame 10 which houses the blades 35 could be placed, rather then internally, above or below the counter-frame 11.

The inner frame 10 and the counter-frame 11 can be easily separated, in the points corresponding to the four actuators 40, facilitating the maintenance operations or the change of kind of working. The whole inner frame 10 holding the blades can be in fact easily replaced, in order to change working, for example from marble to granite, or when it is necessary to modify the thickness of the slabs.

The four actuators 40 are controlled synchronously and allow cyclic movements of approaching and moving away of the blades relative to the block, independently from the reciprocal approaching movement between blades and block during cutting.

Figure 4:
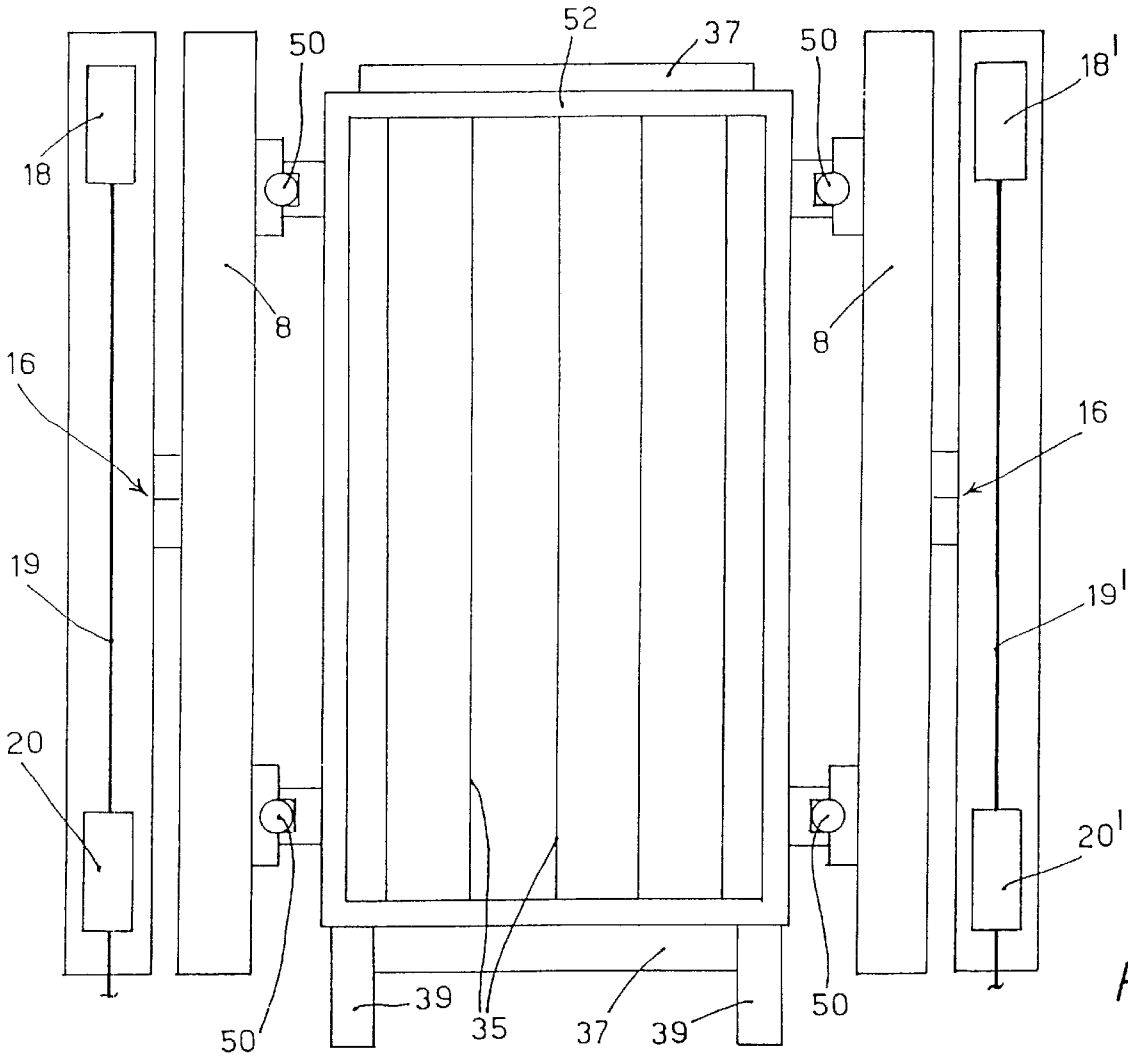
FIG. 4 is a top view of a second embodiment of a blade frame of a gangsaw realised according to the present invention.

In FIG. 4 is shown, in a top view, a different embodiment of the blade frame unit. The blade frame 52 is coupled to the longitudinal sliding guides 8 by means of four actuators 50 that, allowing reciprocal movements in a vertical direction perpendicular to the cutting direction of the blades, move the blade frame 52 on parallel planes.

The blade frame 52, which holds a plurality of blades 35 and the corresponding tensioning mechanisms 37, is coupled directly to the connecting rod/crank system for the transmission of the reciprocating motion, by means of the coupling points 39.

The actuators 40 and 50 used in both the embodiments can be pneumatic actuators, hydraulic oleo-dynamic, electromagnetic or, mechanic.

The speed, the travel and the frequency of the reciprocal movements obtained between blade frame and block to be cut are adjustable at will and are defined every time by the program chosen. Adjusting said parameters it is therefore possible to establish the impact speed of the diamond sectors on the material to be cut, the pressure exercised and the repetition frequency of the eventual chipping blows.

Figure 5:
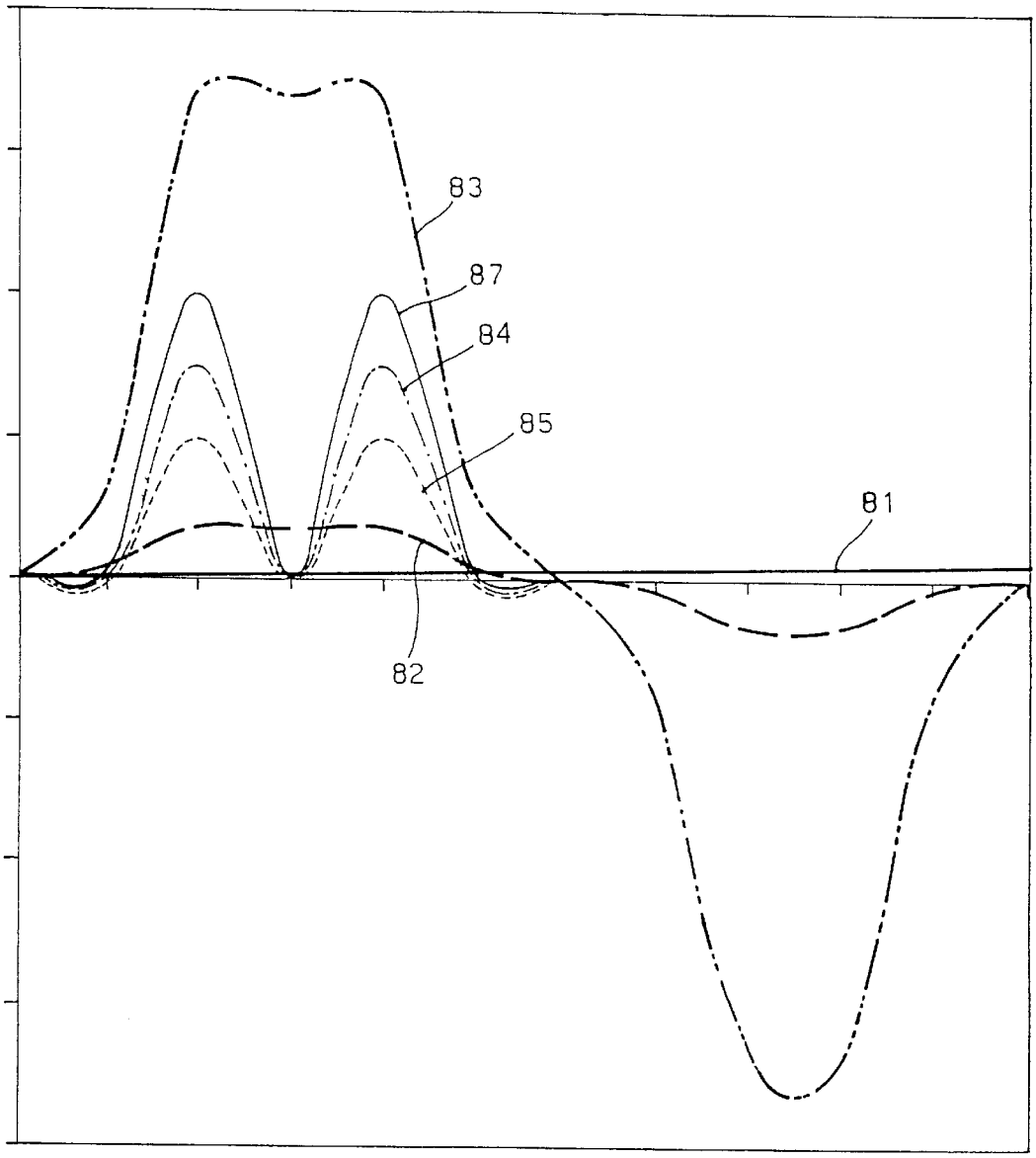
FIG. 5 is a diagram of a first working cycle of a gangsaw realised according to the present invention.
Figure 6:
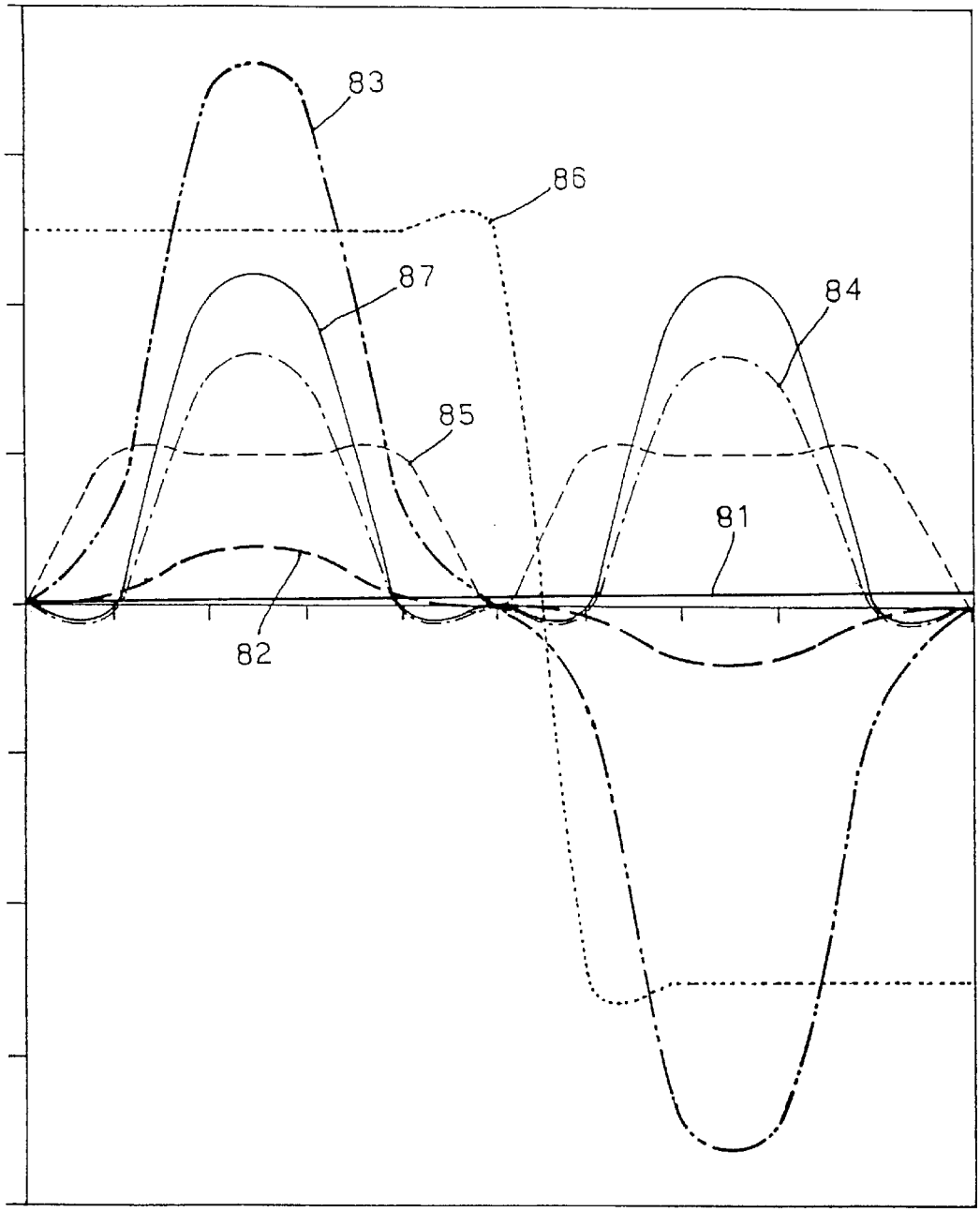
FIG. 6 is a diagram of a second working cycle of a gangsaw realised according to the present invention.
Figure 7:
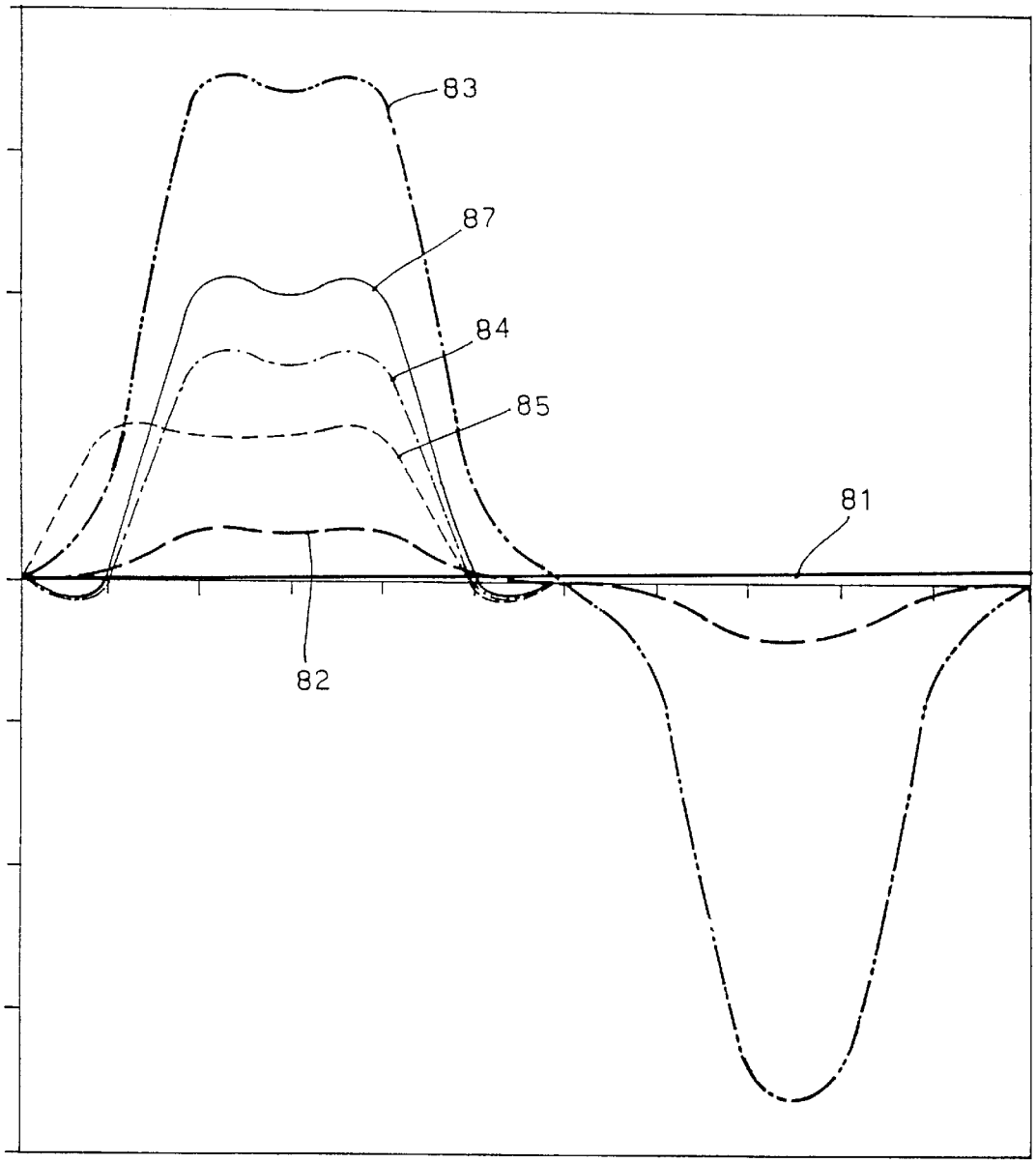
FIG. 7 is a diagram of a third working cycle of a gangsaw realised according to the present invention.

The FIGS. 5, 6 and 7 show three diagrams relative to different working cycles, in particular in the diagram of FIG. 5 it is shown a one-way cutting operation having a double cutting contact with the material, in the diagram of FIG. 6 it is shown a two-way cutting operation, using the hunting function and carrying out a contact at every half cycle, and finally in the diagram of FIG. 7 it is shown a one-way cutting operation having a single contact with the material when the speed of the blade frame is higher and constant.

The curves shown in the diagrams represent respectively:

81 the time;

82 the speed of the longitudinal reciprocating movement of the blade frame;

83 the acceleration of the longitudinal reciprocating movement of the blade frame;

84 the contact pressure of the blades on the material;

85 the approach of the blades relative to the material;

86 the inclination of the cutting (hunting);

87 the contact with the material.

What is claimed is:

1. A method for cutting blocks of stone, conglomerate or concrete into slabs or blocks by means of a gangsaw (1) provided with blades (35) having sectors containing abrasive material and with a water cooling and lubricating system, comprising the steps of:

providing a reciprocal approaching movement between said blades (35) and said block (12), and providing a periodical longitudinal reciprocating movement of said blades (35) relative to said block (12), and providing a cyclic movement of approaching and moving away of said blades (35) relative to said block (12), in a direction substantially perpendicular to the direction of said periodical reciprocating movement and independently from said reciprocal approaching movement.

2. Method according to claim 1, wherein the travel of said cyclic movement of approaching and moving away of said blades (35) relative to said block (12) is adjustable in order to change the pressure exercised by the blades (35) on the block (12).

3. Method according to claim 1, wherein the speed of said cyclic movement of approaching and moving away of said blades (35) relative to said block (12) is adjustable in order to change the impact force and the contact travel exercised by the blades (35) on the block (12).

4. Method according to claim 1, wherein said cyclic movement of approaching and moving away of said blades (35) relative to said block (12) is repeated more times during at least one of the forward and reverse phases of the periodical longitudinal reciprocating movement of said blades (35) relative to said block (12).

5. Method according to claim 1, wherein the frequency of said periodical longitudinal reciprocating movement of the blades (35) relative to the block (12) is adjustable in order to precisely control the frequency and the working cycle of the cyclic movement of approaching and moving away of said blades (35) relative to said block (12).

6. Method according to any one of the preceding claims, in which the travel of the blades (35), during the periodical longitudinal reciprocating movement, is inclined in a first direction (8') not parallel to the base of the block (12) during a forward movement of the blades (35) and is inclined in a second direction (8") opposite to the first direction during a reverse movement of the blades (35).

7. A frame cutting machine (1) for cutting blocks of stone, conglomerate or concrete into slabs or blocks, comprising:

a supporting structure (2, 4, 6) for supporting, by means of longitudinal sliding guides (8), a blade-holder frame (10, 11, 52) coupled to means for motion generation and transmission (30, 32, 26, 28) suitable for moving the blade-holder frame in a periodic reciprocating movement along predetermined paths, a plurality of parallel blades (35) set in said blade-holder frame and containing abrasive material, and a reciprocal approaching system between said blade-holder frame and said block (12), wherein the frame cutting machine comprises a cyclic movement system (40; 50) of approaching and moving away of said blade-holder frame relative to said block (12), in a direction substantially perpendicular to the direction of said periodical reciprocating movement of the blades and independently from said reciprocal approaching movement.

8. Machine according to claim 7, wherein said cyclic movement system (40; 50) of approaching and moving away of said blade-holder frame (52) relative to said block (12) comprises means (50) for shifting said blade-holder frame (52) relative to said longitudinal sliding guides (8) on parallel planes perpendicular to the cutting direction of the blades (35).

9. Machine according to claim 8 wherein said means for shifting said blade-holder frame comprises an actuator from the group consisting of a mechanical actuator, an electromechanical actuator, a pneumatic actuator, a hydraulic oleo-dynamic actuator, and an electromagnetic actuator.

10. Machine according to claim 7, wherein said cyclic movement system (40; 50) of approaching and moving away of said blade-holder frame (52) relative to said block (12) comprises means (50) for shifting said longitudinal sliding guides (8) on parallel planes perpendicular to the cutting direction of the blades (35).

11. Machine according to claim 10, wherein said means for shifting said longitudinal sliding guides (8) comprise actuators of the type mechanical or electromechanical or pneumatic or hydraulic oleo-dynamic or electromagnetic.

12. Machine according to any one of claims 7 or 8 to 11 wherein said longitudinal sliding guides (8) can be inclined, during periodic reciprocating movement of the blades (35), in a first direction (8') not parallel to the base of the block (12) during a forward movement of the blades (35) and in a second direction (8") opposite to the first direction during a reverse movement of the blades (35).

13. A frame cutting machine (1) for cutting blocks of stone, conglomerate or concrete into slabs or blocks, comprising:

a supporting structure (2, 4, 6) for supporting, by means of longitudinal sliding guides (8), a blade-holder frame (10, 11, 52) coupled to means for motion generation and transmission (30, 32, 26, 28) suitable for moving the blade-holder frame in a periodic reciprocating movement along predetermined paths, a plurality of parallel blades (35) set in said blade-holder frame and containing abrasive material, and a reciprocal approaching system between said blade-holder frame and said block (12), wherein the frame cutting machine comprises a cyclic movement system (40; 50) of approaching and moving away of said blade-holder frame relative to said block (12), in a direction substantially perpendicular to the direction of said periodical reciprocating movement of the blades and independently from said reciprocal approaching movement; and wherein the blade-holder frame comprises a first part (10) suitable for supporting the blades (35) and the corresponding tensioning mechanisms (37), and a second part (11) coupled to said means for motion generation and transmission suitable for transferring the reciprocating movement to said first part (10), said first (10) and said second (11) part of the blade-holder frame being connected together in order to allow, cyclic approaching and moving away movements of said first part relative to the block (12).

14. Machine according to claim 13, wherein said cyclic approaching and moving away movements of said first part relative to the block (12) are controlled by means of actuators (40) of the type mechanical or electromechanical or pneumatic or hydraulic oleo-dynamic or electromagnetic.

15. Machine according to claim 13 or 14, wherein said longitudinal sliding guides (8) can be inclined, during periodic reciprocating movement of the blades (35), in a first direction (8') not parallel to the base of the block (12) during a forward movement of the blades (35) and in a second direction (8") opposite to the first direction during a reverse movement of the blades (35).

* * * * *